US009310156B2

(12) United States Patent
Whitaker et al.

(10) Patent No.: US 9,310,156 B2
(45) Date of Patent: Apr. 12, 2016

(54) PROJECTILE LAUNCHER

(71) Applicants: Todd Michael Whitaker, Boulder, CO (US); Adam Cuthbert Pauluhn, Niwot, CO (US); Mark A. Beran, Niwot, CO (US)

(72) Inventors: Todd Michael Whitaker, Boulder, CO (US); Adam Cuthbert Pauluhn, Niwot, CO (US); Mark A. Beran, Niwot, CO (US)

( * ) Notice: Subject to any disclaimer, the term of this patent is extended or adjusted under 35 U.S.C. 154(b) by 0 days.

(21) Appl. No.: 14/537,592

(22) Filed: Nov. 10, 2014

(65) Prior Publication Data

US 2015/0136104 A1 May 21, 2015

Related U.S. Application Data

(60) Provisional application No. 61/902,082, filed on Nov. 8, 2013.

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
USPC ..... 124/25
See application file for complete search history.

(56) References Cited

U.S. PATENT DOCUMENTS

| | | | | |
|---|---|---|---|---|
| 3,261,340 | A * | 7/1966 | Laird | A63B 69/408 124/36 |
| 3,515,113 | A * | 6/1970 | Lawrence | F41B 5/12 124/25 |
| 4,530,342 | A * | 7/1985 | Simo | F41B 5/10 124/23.1 |
| 2009/0032002 | A1 * | 2/2009 | Howard | F41B 5/10 124/25.6 |

* cited by examiner

*Primary Examiner* — Gene Kim
*Assistant Examiner* — Jeffrey Vanderveen
(74) *Attorney, Agent, or Firm* — Robert A. Parsons; Michael W. Goltry; Parsons & Goltry

(57) ABSTRACT

A projectile launcher includes a body having a rearward end, and a forward end. A pair of arms is pivotally coupled to the body and a bowstring extends between the ends of the pair of arms and is movable between a cocked position and a released position. Tubular torsion bars are coupled to the pair arms to store and release mechanical energy. A mechanical energy delivery system couples the tubular torsion bars to the pair arms. The mechanical energy delivery system transfers mechanical energy to the tubular torsion bars when the bowstring is moved from the released position to the cocked position, and transfers mechanical energy from the tubular torsion bars to the pair arms to move the bowstring from the cocked position to the released position.

8 Claims, 6 Drawing Sheets

PROJECTILE LAUNCHER

CROSS-REFERENCE TO RELATED APPLICATION

This application claims the benefit of U.S. Provisional Application No. 61/902,082, filed 8 Nov. 2013.

FIELD OF THE INVENTION

This invention relates to mechanisms for launching projectiles.

More particularly, the present invention relates to projectile mechanisms using stored mechanical energy.

BACKGROUND OF THE INVENTION

In the field of projectile launchers, there are three main categories, chemical energy devices (i.e. firearms), compressed air devices (i.e. air guns), and mechanical energy devices, (i.e. crossbows). Each have particular strengths and weaknesses. Chemical energy devices typically use gun powder and can be very high powered, deliver a projectile accurately and with power at great distances, and can accomplish this in a relatively small device with a small package (cartridge). One drawback is that they are loud and very noticeable. A large amount of time, effort and resources have gone to reducing the result of the chemical reaction of a firearm, (i.e. suppressors, flash guards and the like). Projectile launchers that can provide similar characteristics to chemical energy devices while eliminating the noise and flash are desired.

To meet this need, many advances to compressed air devices such as air guns have been developed. While the compressed air used in air guns is easily and cheaply provided, is quiet in operation with no flash, and can provide great accuracy, the projectile is generally very small and light, and very limited in range. Thus, the projectile falls far short of the power and range of a projectile provided in a chemical energy device such as a firearm.

Mechanical energy devices, specifically crossbows, can provide great power with a large projectile. They are quiet to use with no flash, and are cost effective since the mechanical energy device can typically be reset. The problem with these devices is that they are relatively short ranged, and become more difficult to use and larger as the power and range is increased. To increase range and power, the mechanical energy stored in the device must be increased. This is accomplished by increasing the draw weight of the bow. Increased draw weight is limited by the materials used in the arms of the bow and the size of the bow itself. The larger the bow and the stiffer the material, the greater the power generated. Additionally, the draw length, resulting from the length of the arms, affects the power generated. Therefore, a bow of great power must necessarily be large and often use expensive and exotic materials.

It would be highly advantageous, therefore, to remedy the foregoing and other deficiencies inherent in the prior art.

An object of the present invention is to provide a new and improved projectile launcher.

Another object of the invention is to provide a projectile launcher that is quiet, generates no flash, and is powerful and accurate.

And another object of the present invention is to provide a projectile launcher using a powerful mechanical energy storage system.

SUMMARY OF THE INVENTION

Briefly, to achieve the desired objects and advantages of the instant invention provided is a projectile launcher. The projectile launcher includes a body having a rearward end, and a forward end. A pair of rigid arms is provided, each have a pivot end pivotally coupled to opposing sides of the body proximate the forward end thereof and a distal end. A bowstring extends between the distal ends of the pair of arms and is movable between a cocked position and a released position. A latch mechanism is movable between a closed position, retaining the bowstring in the cocked position, and an open position, releasing the bowstring to allow movement to the released position. At least one tubular torsion bar is coupled to the pair of rigid arms, and is movable between a mechanical energy storage configuration and a mechanical energy releasing configuration. A mechanical energy delivery system couples the at least one tubular torsion bar to the pair of rigid arms, transferring mechanical energy to the at least one tubular torsion bar when the bowstring is moved from the released position to the cocked position, and transferring mechanical energy from the at least one tubular torsion bar to the pair of rigid arms to move the bowstring from the cocked position to the released position.

In a specific aspect, the mechanical energy delivery system includes an upper pulley pivotally coupling each of the pair of rigid arms to the body. At least one lower pulley coupled to the at least one tubular torsion bar and each upper pulley, and a cable coupled between the at least one lower pulley and the upper pulleys.

The at least one tubular torsion bar includes an outer tubular member anchored to the body by a mounting ferrule at an end thereof, and an inner member extending beyond the end of the outer tubular member and terminating in an output ferrule. The at least one lower pulley is attached directly to the output ferrule of the at least one tubular torsion bar and rotates therewith.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 2:
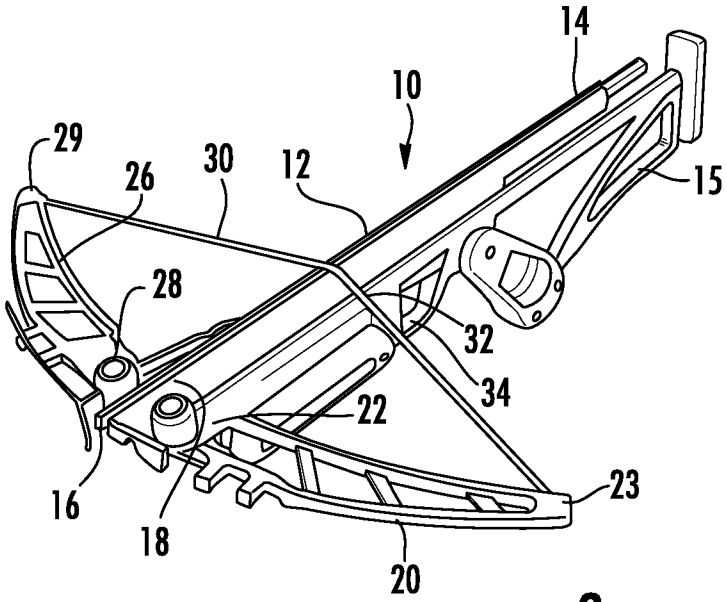
FIG. 2 is a perspective top view of the arm projectile launcher of FIG. 1.
Figure 1:
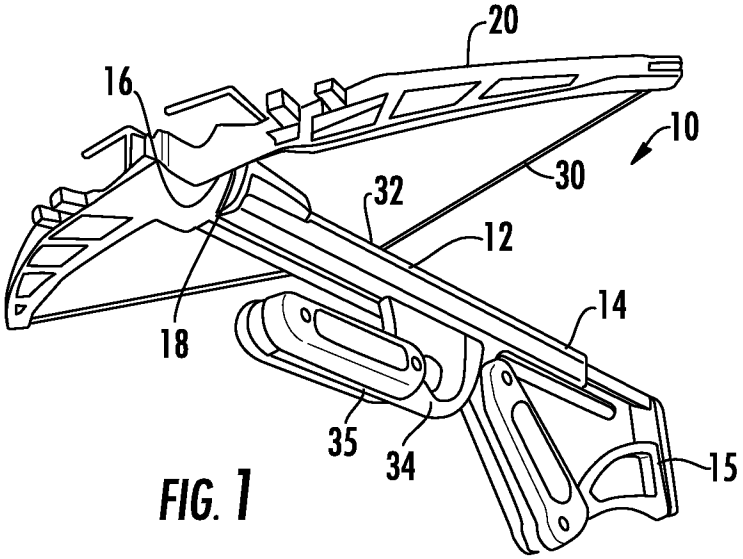
FIG. 1 is a perspective bottom view of an arm projectile launcher according to the present invention.

Turning now to the drawings in which like reference characters indicate corresponding elements throughout the several views, attention is directed to FIGS. 1 and 2 which illustrate an arm projectile launcher generally designated 10. Launcher 10 includes a body 12 having a rearward end 14, terminating in a buttstock 15, and a forward end 16 terminating in a riser structure 18. Body 12 receives, supports, and guides a projectile, preferably along a groove formed on a top surface thereof. Body 12 carries an arm bow having arms to accelerate a projectile and is powered by tubular torsion bars and an energy delivery system, as will be described presently. An arm 20 includes a pivotal end 22 coupled to riser structure 18 to one side of body 12 and terminating in a distal end 23. An arm 26 includes a pivotal end 28 coupled to riser structure 18 to the opposite side of body 12 from pivotal end 22, and terminating in a distal end 29. Arm 20 and arm 26 are preferably rigid members which pivot at body 12, and do not flex as in traditional crossbows. A bowstring 30 is coupled to and extends between distal end 23 and distal end 29. Bowstring 30 is movable between a cocked position and a released position. In the cocked position, bowstring 30 is pulled rearwardly and retained by a latch mechanism 32. Latch mechanism 32 is movable between an open and a closed position by a trigger assembly 34 coupled thereto. In the closed configuration, latch mechanism 32 retains bowstring 30 in the cocked position. In the open configuration, latch mechanism 32 disengages bowstring 30, releasing it to the released position. While not described in any detail, a cocking mechanism 35 is provided and can include substantially any conventional mechanism used in conventional crossbows for moving the bowstring rearwardly to the cocked position. These mechanisms can include levers, cranks, a user fingers and the like. In the present embodiment, a lever mechanism is illustrated.

Figure 3:
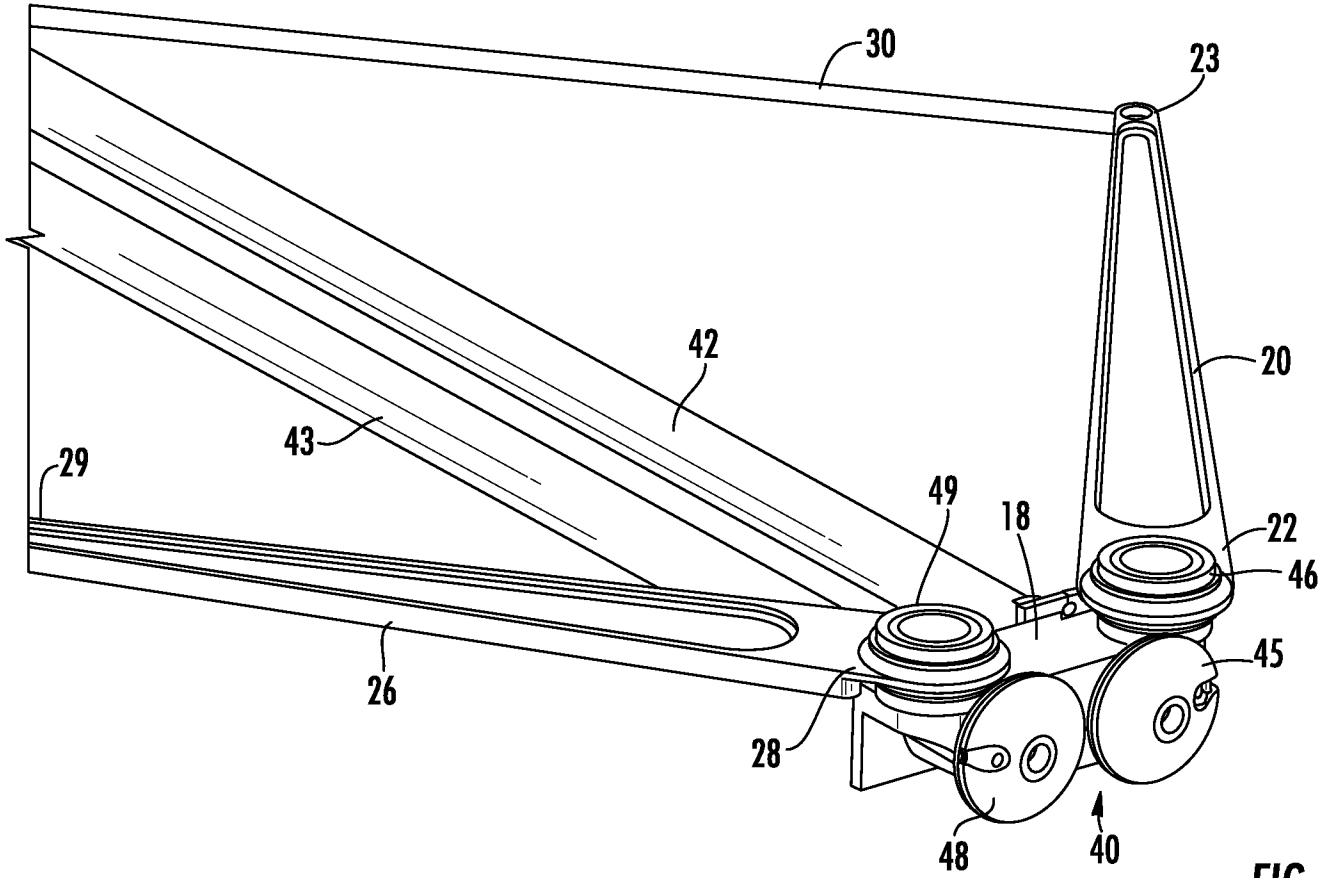
FIG. 3 is a perspective view of the energy storage and delivery system of the arm projectile launcher.

Referring now to FIG. 3, an energy storage and delivery system generally designated 40 of launcher 10 is illustrated. Energy storage and delivery system 40 includes a pair of parallel tubular torsion bars 42 and 43 coupled to riser 18 for storage of mechanical energy, and a energy delivery system including pulleys and cables coupled between tubular torsion bars 42 and 43 and arms 20 and 26. Tubular torsion bars 42 and 43 each move between a mechanical energy storage configuration and a mechanical energy released configuration. A lower pulley 45 and an upper pulley 46 are carried by riser 18 and associated with arm 20 and tubular torsion bar 42, and a lower pulley 48 and an upper pulley 49 are carried by riser 18 and associated with arm 26 and tubular torsion bar 43. As can be seen, arms 20 and 26 are coupled to riser 18 by upper pulleys 46 and 49, respectively, to which they are fixedly attached. Arms 20 and 26 are pivotally movable, rearwardly and forwardly as upper pulleys 46 and 49 rotate, respectively. Arms 20 and 26 are movable rearwardly when bowstring 30 is moved to the cocked position and move forwardly when bowstring 30 is moved to the release position. When bowstring 30 is pulled rearwardly by a cocking mechanism or a user's fingers to the cocked position, arms 20 and 26 rotate rearwardly. This rearward rotation moves tubular torsion bars 42 and 43 to the mechanical energy storing configuration through the energy delivery system. When bowstring 30 is released from latch mechanism 32, it is moved to the release position by the forward rotation of arms 20 and 26. This forward rotation results from tubular torsion bars 42 and 43 releasing the stored mechanical energy as they move to the mechanical energy release configuration. The energy delivery system transfers this energy release to arms 20 and 26. Tubular torsion bars 42 and 43 will not be described in detail herein, as they are described in detail in U.S. Pat. No. 8,505,888, included herein by reference.

Figure 4:
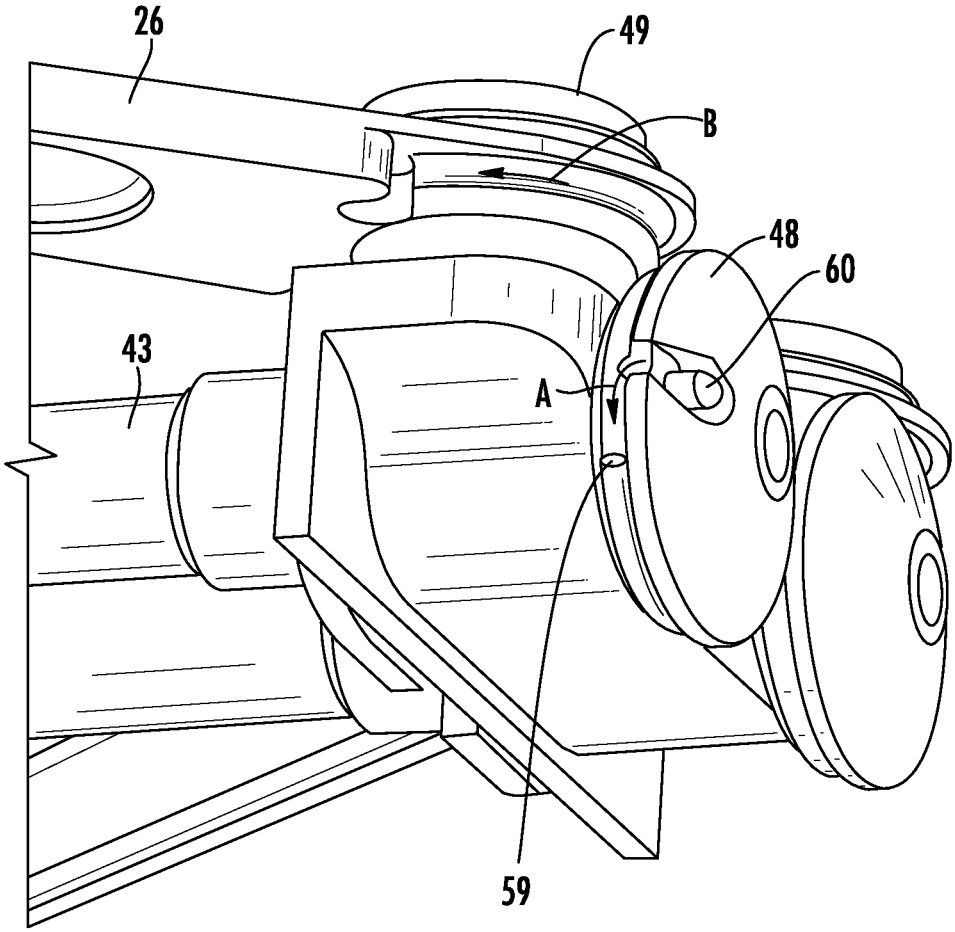
FIG. 4 is a perspective view of the pulley system of the present invention.
Figure 5:
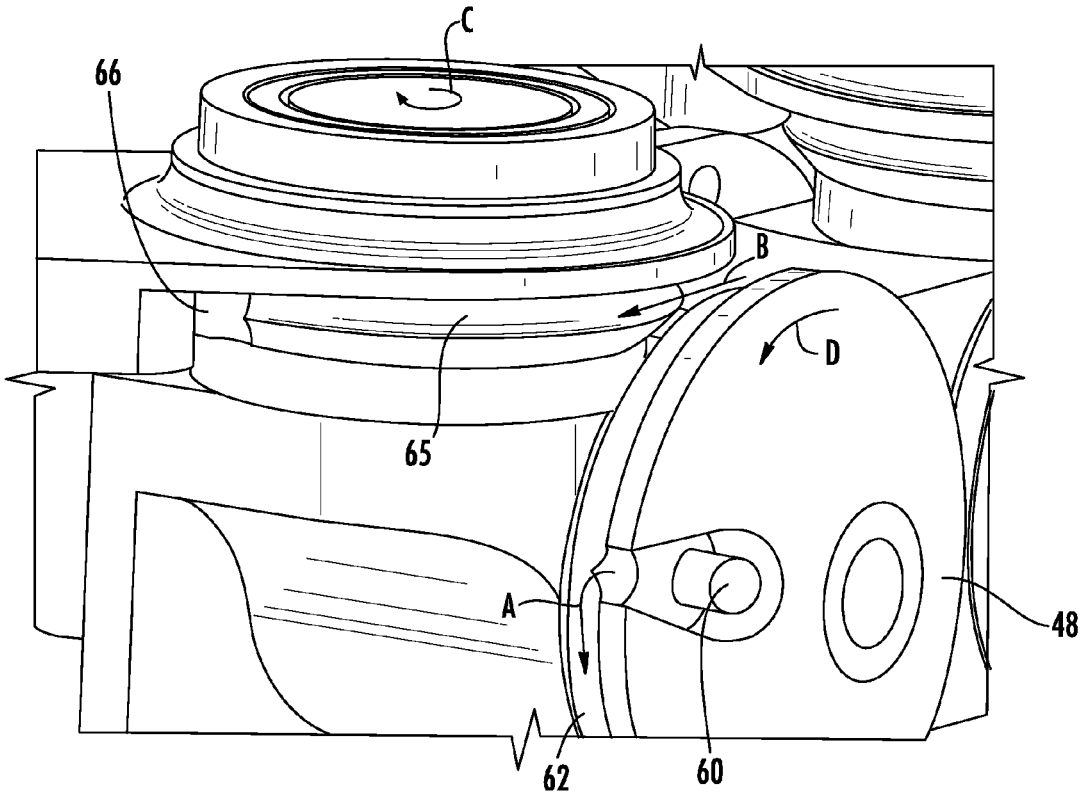
FIG. 5 is an enlarged partial perspective view of the pulley system of FIG. 4.
Figure 6:
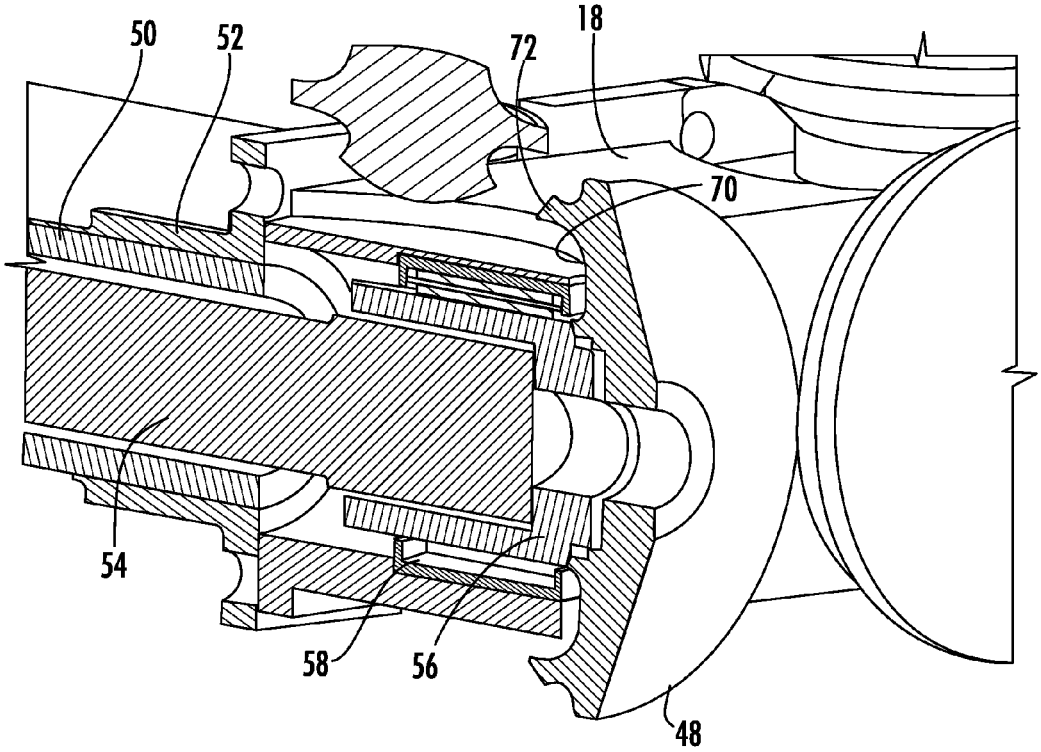
FIG. 6 is a sectional view of a pulley coupled to the tubular torsion bar.

Turning now to FIGS. 4-6, each set of pulleys, lower pulley 45 and upper pulley 46 associated with arm 20 and tubular torsion bar 42, and lower pulley 48 and upper pulley 49 associated with arm 26 and tubular torsion bar 43 is driven by the associated tubular torsion bar and act as the energy delivery system. With particular reference to FIG. 6, each lower pulley 45 and 48 is coupled through riser 18 to its associated tubular torsion bar 42 and 43 respectively. Since each is identical, only the attachment of lower pulley 48 is illustrated. As can be seen, tubular torsion bar 43 has an outer tubular member 50 anchored to riser 18 by a mounting ferrule 52. An inner member 54 extends beyond the end of outer tubular member 50 and terminated in an output ferrule 56. Lower pulley 48 is attached directly to output ferrule 56 and rotated therewith. Output ferrule 56 and lower pulley 48 are supported within riser 18 by a needle bearing 58. Lower pulley 48 includes an annular cut-out portion 70 forming an overhanging element 72 carrying the cable groove formed on the periphery of the pulley. In this manner the load from the cable, described presently, is directly transferred onto the roller of the needle bearing 58.

Referring back to FIGS. 4 and 5, a cable 59, only partially shown for simplicity, has an end anchored at a retention feature 60 and enters a cable groove 62 formed around the periphery of lower pulley 48 as indicated by arrowed line A. Cable 59 encircles a portion of pulley 48 and passes between lower pulley 48 to upper pulley 49 following arrowed line B entering a cable groove 65 formed around the periphery of upper pulley 49. The cable terminates at a retention feature 66 on upper pulley 49. Thus, as bowstring 30 is moved rearwardly to the cocked position, arm 26 is moved rearwardly to the cocked position. By pivoting arm 26 rearwardly, upper pulley 49 is rotated in the direction of arrowed line C, pulling the cable away from lower pulley 48 which rotates in the direction indicated by arrowed line D. Rotation of lower pulley 48, in turn, rotates inner member 54 with respect to outer tubular member 50, storing energy therein (energy storage configuration). Upon releasing bowstring 30, the components reverse direction under the stored energy of tubular torsion bar 43. Thus, inner member 54 rotates in the opposite direction with respect to outer tubular member 50, releasing energy therefrom (energy releasing configuration). The identical process occurs on the opposite side of launcher 10 with tubular torsion bar 42, lower pulley 45 and upper pulley 46. The energy released snaps bowstring 30 to the released position, driving a projectile down body 12.

Figure 7:
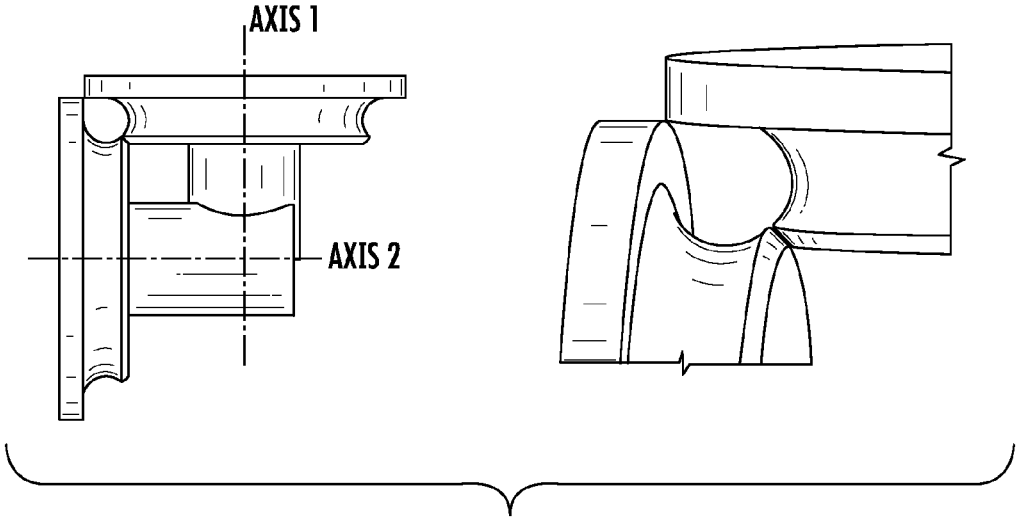
FIG. 7 is a side view of the non-interfering pulleys of the present invention.

Turning now to FIG. 7, each pulley set is formed with the inside wall of the upper pulley and the lower pulley cut down to provide clearance between the upper pulley and the lower pulley. With the non-interfering pulleys, when the cable is being pulled by the tubular torsion bars 42 and 43, the cable will be fully constrained on both pulleys within the cable groove. It is therefore not necessary for the cable groove to have extremely high sidewalls on both sides. With proper axial alignment and pulley positioning, it is possible to remove one of the walls of the cable groove entirely. Removing the inside wall of each pulley relative each other, allows for the pulley axes to be located closer to each other relative to the centerline axis of acceleration of the projectile, namely the center of body 12.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A projectile launcher comprising:

a body having a rearward end, and a forward end;

a pair of rigid arms, each having a pivot end pivotally coupled to opposing sides of the body proximate the forward end thereof and a distal end;

a bowstring extending between the distal ends of the pair of arms and movable between a cocked position and a released position;

a latch mechanism movable between a closed position, retaining the bowstring in the cocked position, and an open position, releasing the bowstring to allow movement to the released position;

at least one tubular torsion bar coupled to the pair of rigid arms, the at least one tubular torsion bar movable between a mechanical energy storage configuration and a mechanical energy releasing configuration; and a mechanical energy delivery system coupling the at least one tubular torsion bar to the pair of rigid arms, the mechanical energy delivery system transferring mechanical energy to the at least one tubular torsion bar when the bowstring is moved from the released position to the cocked position, and transferring mechanical energy from the at least one tubular torsion bar to the pair of rigid arms to move the bowstring from the cocked position to the released position;

an upper pulley pivotally coupling each of the pair of rigid arms to the body;

at least one lower pulley coupled to the at least one tubular torsion bar and each upper pulley; and a cable coupled between the at least one lower pulley and the upper pulleys.

2. A projectile launcher as claimed in claim 1 wherein the at least one tubular torsion bar includes an outer tubular member anchored to the body by a mounting ferrule at an end thereof, and an inner member extending beyond the end of the outer tubular member and terminating in an output ferrule, wherein the at least one lower pulley is attached directly to the output ferrule of the at least one tubular torsion bar and rotates therewith.

3. A projectile launcher comprising:

a body having a rearward end, and a forward end;

a pair of rigid arms, each having a pivot end pivotally coupled to opposing sides of the body proximate the forward end thereof and a distal end;

a bowstring extending between the distal ends of the pair of arms and movable between a cocked position and a released position;

a pair of tubular torsion bars coupled to the pair of rigid arms, the pair of tubular torsion bars movable between a mechanical energy storage configuration and a mechanical energy releasing configuration; and a mechanical energy delivery system coupling the pair of tubular torsion bars to the pair of rigid arms, the mechanical energy delivery system transferring mechanical energy to the pair of tubular torsion bars when the bowstring is moved from the released position to the cocked position, and transferring mechanical energy from the pair of tubular torsion bars to the pair of rigid arms to move the bowstring from the cocked position to the released position;

a pair of lower pulleys and a pair of upper pulleys carried by the body and one each associated with one of the pair of rigid arms and one of the pair of tubular torsion bars, the pair of lower pulleys coupled to the pair of tubular torsion bars to transfer mechanical enemy thereto and therefrom; and a pair of cables coupled one each between the pair of lower pulleys and the pair of upper pulleys.

4. A projectile launcher as claimed in claim 3 wherein the pair of rigid arms are each pivotally coupled to opposing sides of the body by the pair of upper pulleys.

5. A projectile launcher as claimed in claim 3 wherein the pair of tubular torsion bars each include an outer tubular member anchored to the body by a mounting ferrule at an end thereof, and an inner member extending beyond the end of the outer tubular member and terminating in an output ferrule, wherein the pair of lower pulleys are attached, one each, directly to the output ferrule of the pair of tubular torsion bars and rotate therewith.

6. A projectile launcher comprising:

a body having a rearward end, and a forward end;

a first arm having a pivotal end pivotally coupled to a first side of the body and terminating in a distal end;

a second arm having a pivotal end pivotally coupled to a second side of the body, and terminating in a distal end;

a bowstring coupled to and extending between the distal end of the first arm and the distal end of the second arm and movable between a cocked position and a released position;

a latch mechanism movable between a closed position, retaining the bowstring in the cocked position, and an open position, releasing the bowstring to allow movement to the released position;

a first tubular torsion bar coupled to the first arm, the first tubular torsion bar movable between a mechanical energy storage configuration and a mechanical energy releasing configuration;

a second tubular torsion bar coupled to the second arm, the second tubular torsion bar movable between a mechanical energy storage configuration and a mechanical energy releasing configuration; and a mechanical energy delivery system coupling the first and second tubular torsion bars to the first and second arms, respectively, the mechanical energy delivery system transferring mechanical energy to the first and second tubular torsion bars when the bowstring is moved from the released position to the cocked position, and transferring mechanical energy from the first and second tubular torsion bars to the first and second arms to move the bowstring from the cocked position to the released position;

a first lower pulley and a first upper pulley carried by the body and associated with the first arm and first tubular torsion bar, the first lower pulley coupled to the a first tubular torsion bar to transfer mechanical energy thereto and therefrom;

a first cable coupled between the first lower pulley and the first upper pulley;

a second lower pulley and a second upper pulley carried by the body and associated with the second arm and second tubular torsion bar; and a second cable coupled between the second lower pulley and the second upper pulley.

7. A projectile launcher as claimed in claim 6 wherein the first arm is pivotally coupled to the first side of the body by the first upper pulley and the second arm is pivotally coupled to the second side of the body by the second upper pulley.

8. A projectile launcher as claimed in claim 6 wherein the first tubular torsion bar and the second tubular torsion bar each include an outer tubular member anchored to the body by a mounting ferrule at an end thereof, and an inner member extending beyond the end of the outer tubular member and terminating in an output ferrule, wherein the first and second lower pulleys are attached directly to the output ferrule of the first and second tubular torsion bar, respectively, and rotate therewith.

* * * * *